US010947010B2

(12) United States Patent
Castelli

(10) Patent No.: US 10,947,010 B2
(45) Date of Patent: Mar. 16, 2021

(54) STACKABLE BUCKET SYSTEM

(71) Applicant: Anthony Castelli, Saint Charles, MO (US)

(72) Inventor: Anthony Castelli, Saint Charles, MO (US)

( * ) Notice: Subject to any disclaimer, the term of this patent is extended or adjusted under 35 U.S.C. 154(b) by 34 days.

(21) Appl. No.: 16/441,835

(22) Filed: Jun. 14, 2019

(65) Prior Publication Data

US 2020/0002056 A1 Jan. 2, 2020

Related U.S. Application Data

(60) Provisional application No. 62/691,015, filed on Jun. 28, 2018.

(51) Int. Cl.

*B65D 21/00* (2006.01)
*B65D 21/02* (2006.01)
*B65D 25/32* (2006.01)

(52) U.S. Cl.

CPC ..... *B65D 21/0233* (2013.01); *B65D 25/32* (2013.01)

(58) Field of Classification Search

CPC ..... B65D 21/02; B65D 21/0212; B65D 21/0233; B65D 25/32; B65D 25/28; B65D 25/2835

USPC ..... 220/770, 773; 206/501, 506, 519, 515

See application file for complete search history.

(56) References Cited

U.S. PATENT DOCUMENTS

| | | | | |
|---|---|---|---|---|
| 4,181,226 | A | 1/1980 | Weinert | |
| 5,199,571 | A | 4/1993 | Wolff et al. | |
| 8,033,417 | B1 | 10/2011 | Fallacaro | |
| 8,763,810 | B2 | 7/2014 | Zorzo | |
| 2004/0226958 | A1* | 11/2004 | Robellard | B44D 3/128 220/772 |
| 2006/0278553 | A1* | 12/2006 | Diamond | B65D 21/0233 206/515 |
| 2011/0017629 | A1 | 1/2011 | Lee | |
| 2015/0360818 | A1* | 12/2015 | Condiff | B65D 25/2897 220/608 |
| 2018/0086501 | A1* | 3/2018 | Katz | B65D 1/16 |

* cited by examiner

*Primary Examiner* — James N Smalley
*Assistant Examiner* — Elizabeth J Volz
(74) *Attorney, Agent, or Firm* — Boudwin Intellectual Property; Daniel Boudwin

(57) ABSTRACT

A stackable bucket system for carrying multiple substances in different containers at the same time while holding a single handle. The stackable bucket system includes a first container and a second container, wherein the second container is adapted to receive the first container therein and removably couple thereto, with the second container being larger than the first. Each container comprises a base and a perimeter wall ending in a rim at an open top. Handles are included on each container and are pivotally affixed to opposing sides thereof. The handle of the second container is wider than that of the first container and is adapted to fit over top of the handle of the second container. A flange protruding outward from the perimeter wall of the containers is adapted to rest flush against the rim of the open top when of the adjacent container when installed.

13 Claims, 5 Drawing Sheets

STACKABLE BUCKET SYSTEM

CROSS REFERENCE TO RELATED APPLICATIONS

This application claims the benefit of U.S. Provisional Application No. 62/691,015 filed on Jun. 28, 2018. The above identified patent application is herein incorporated by reference in its entirety to provide continuity of disclosure.

BACKGROUND OF THE INVENTION

The present invention relates to nesting or vertical stacking containers. More specifically, the present invention relates to a stackable bucket system including a first container and a second container, wherein handles of the first and second container are configured to removably secure to each other.

When cleaning, it is often necessary to fill two buckets during the process. One bucket is generally needed to provide clean water for rinsing while another bucket is required to hold soapy water for cleaning. Carrying two buckets can make it difficult for many individuals to maneuver around effectively and perform a desired task, such as open a door, carry additional cleaning supplies, and grab onto a railing while climbing or descending stairs. Two buckets can also take up unnecessary space during transportation. Accordingly, a device that is configured to enable an efficient carrying of multiple buckets in tandem is desired.

Devices have been disclosed in the known art that relate to vertical stacking containers. These include devices that have been patented and published in patent application publications. These devices generally relate to nesting receptacles and containers which vertically stack for storage. These devices, however, fail to disclose all the elements of the present invention. For example, the devices in the art do not disclose a stackable bucket system that allows multiple substances to be transported via buckets that stack with interlocking handles.

In light of the devices disclosed in the known art, it is submitted that the present invention substantially diverges in design elements from the known art and consequently it is clear that there is a need in the art for an improvement to existing stackable bucket systems. In this regard, the instant invention substantially fulfills these needs.

SUMMARY OF THE INVENTION

In view of the foregoing disadvantages inherent in the known types of bucket systems now present in the known art, the present invention provides a stackable bucket system wherein the same can be utilized for providing convenience for the user when transporting separate substances for individual use, such as clean and soapy water for washing.

It is therefore an object of the present invention to provide a new and improved stackable bucket system that has all of the advantages of the known art and none of the disadvantages.

It is another object of the present invention to provide a stackable bucket system comprising a first container and a second container, wherein each container includes a base and a perimeter wall terminating in a rim at an open top, wherein the first container is configured to fit within the second container and removably couple thereto. Handles are pivotally affixed to opposing sides of the first and second containers and are configured to removably secure to each other when the first container is installed within the second container. A flange protrudes outward from the perimeter wall of the first and second container at a point lower than the handle connections.

Another object of the present invention is to provide a stackable bucket system wherein the cross-sectional area of the first and second containers is circular, and the diameters of the bases are smaller than that of the open tops.

Yet another object of the present invention is to provide a stackable bucket system wherein the handles each include a central gripping piece having a magnet therein configured to removably secure the handles together via a magnetic connection when the first container is installed within the second container.

Still another object of the present invention is to provide a stackable bucket system wherein the perimeter wall of the second container is higher than that of the first such that an interior volume exists between the bases of the installed containers.

Another object of the present invention is to provide a stackable bucket system wherein the first container fits within the second container such that the flange of the first container and the rim of the second container, along with the perimeter walls, lay flush against each other.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
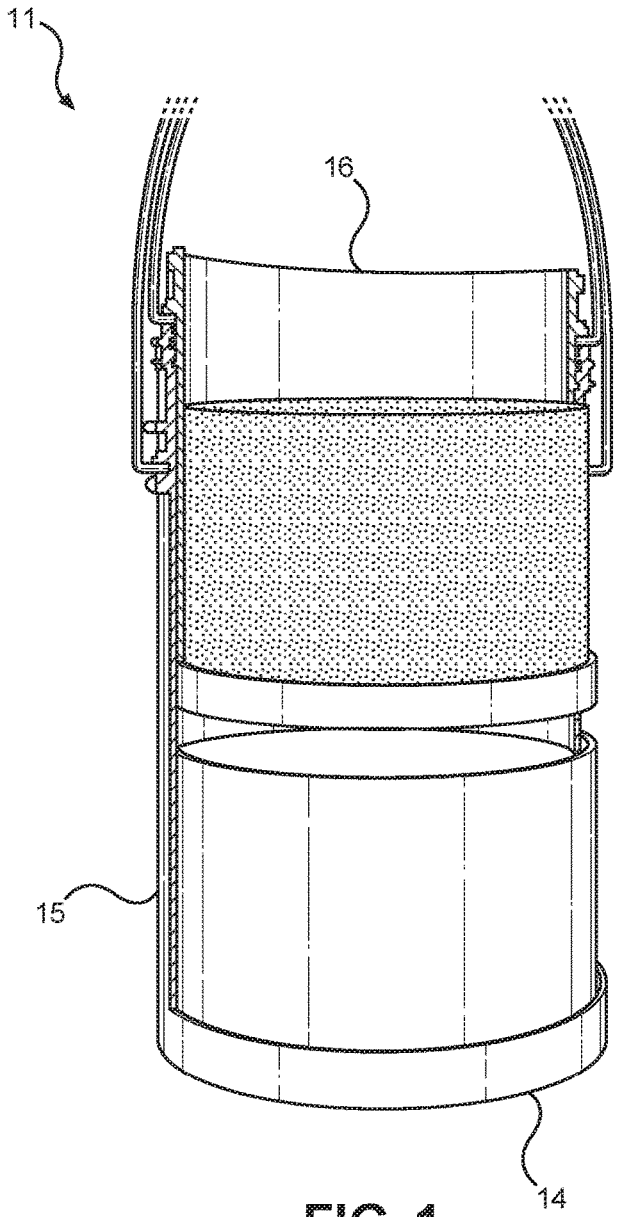
FIG. 1 shows a cross-sectional view of an embodiment of the stackable bucket system showing component parts.

Reference is made herein to the attached drawings. Like reference numerals are used throughout the drawings to depict like or similar elements of the stackable bucket system. For the purposes of presenting a brief and clear description of the present invention, the preferred embodiment will be discussed as used for providing stackable containers for holding and transporting separate substances at the same time. The figures are intended for representative purposes only and should not be considered to be limiting in any respect.

Figure 2:
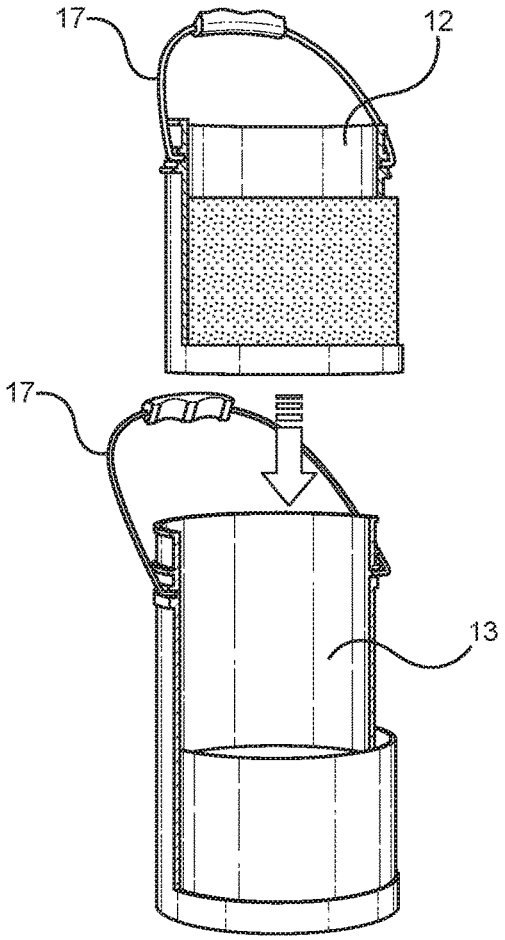
FIG. 2 shows an alternate cross-sectional view of an embodiment of the stackable bucket system showing the first and second containers separated.

Referring now to FIGS. 1 and 2, there are shown cross-sectional views of an embodiment of the stackable bucket system showing component parts. The stackable bucket system 11 comprises two separate and distinct containers which are configured to be removably coupled to one another while providing storage space for separate substances. An example of a use for the stackable bucket system 11 would be for providing distinct space for soapy and clean water for car washing purposes. However, the stackable bucket system 11 may be used for any suitable purpose where it may be desirable to transport and use certain materials while keeping them in separate storage spaces. The stackable bucket system 11 comprises a first container 12 and a second container 13, wherein each of the two storage containers 12 and 13 has a base 14 and a perimeter wall 15 extending upwards therefrom. The perimeter walls 15 terminate in a rim 16 creating an enclosure having an opened top.

The first container 12 is configured to fit within the open top of the second container 13 and removably couple thereto. In the illustrated embodiment, the first container 12 and the second container 13 have a circular cross-section. Each container has a U-shaped handle 17 wherein the ends of the handles 17 are pivotally affixed to opposing sides of a top portion of the perimeter wall 15. The handles 17 are configured to removably secure to one another when the first container 12 is installed within the second container 13. In some embodiments, the containers 12, 13 each have a fill line disposed within the interior volumes thereof, such that the user knows the maximum amount of material that can be placed in the containers.

Figure 3:
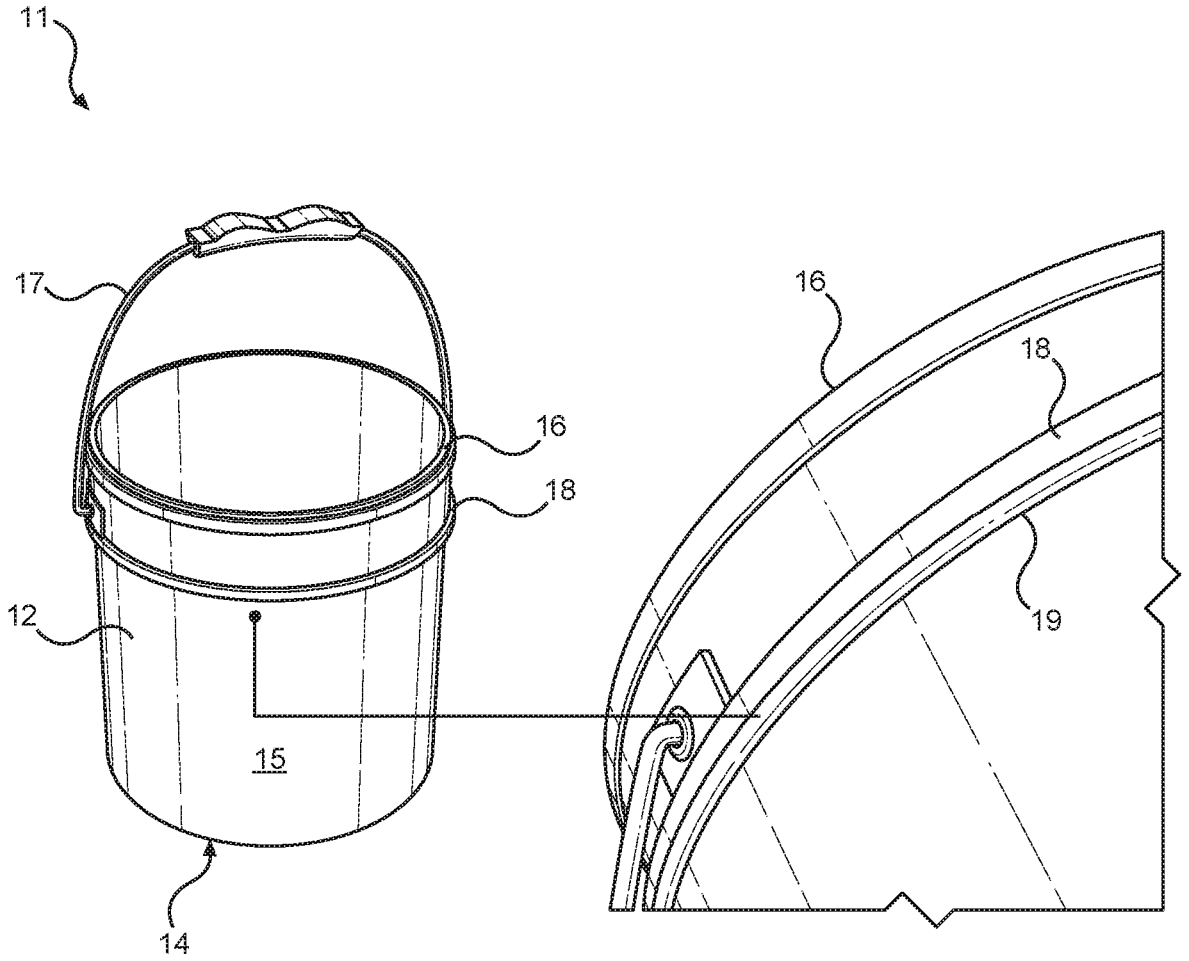
FIG. 3 shows a lower perspective view of an embodiment of the stackable bucket system.
Figure 4:
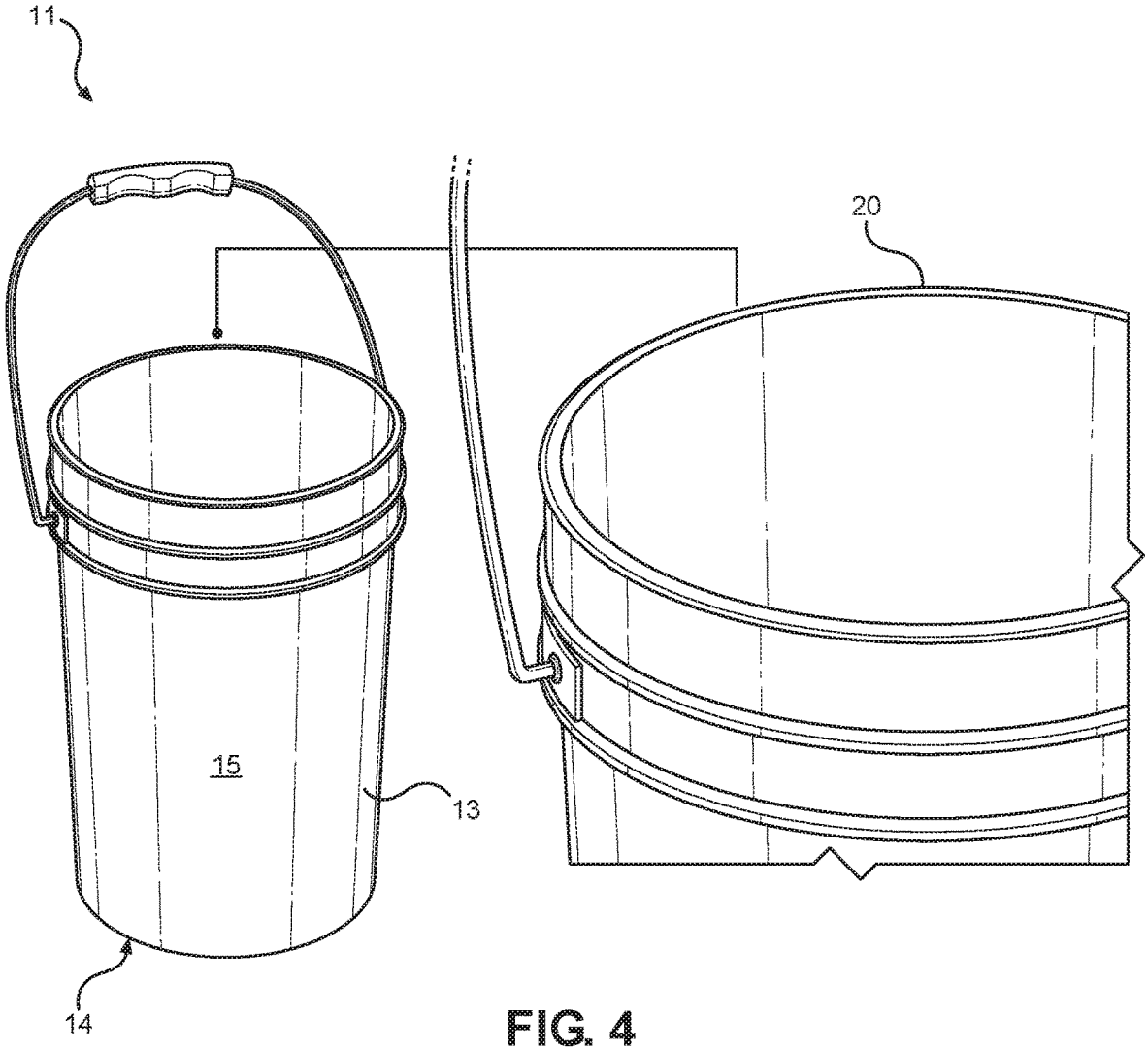
FIG. 4 shows an upper perspective view of an embodiment of the stackable bucket system.

Referring now to FIGS. 3 and 4, there are shown upper and lower perspective views an embodiment of the stackable bucket system, respectively. The diameter of the bases of each container are smaller than the diameter of the rims 16 of the open ends of the containers. In this way, the perimeter walls 15 taper slightly from the base 14 to the open top and allowing the first container 12 to be installed within the second container. The first container 12 has a perimeter wall 15 of a smaller length than that of the second container and is configured to be received within the open top of the second container. A flange 18 extends outward on the perimeter wall 15 at a point below where the handle 17 is pivotally affixed thereon. The flange 18 runs along the exterior surface of the perimeter wall 15 and is parallel to both the base 14 and the rim 16 of the container.

In the illustrated embodiment, the stackable bucket system includes gaskets to ensure a seal between stacked buckets. A first gasket 19 is included along the lower portion of the flange 18. The gasket 19 is adapted to rest flush against the rim 16 of the second container when removably coupled therein. The gasket 19 provides a seal to prevent material stored within the interior volume of the second container from spilling out around the connection point with first container 12 when removably coupled. The gasket 19 comprises an O-ring in the illustrated embodiment. A second gasket may be included in some embodiments along the perimeter wall 15 at the base 14 of the first container 12 for an added seal via friction fit when removably coupled with the second container. While gaskets are included in the illustrated embodiment, other embodiments of the invention may not include the gaskets.

The second container 13 has a perimeter wall 15 of greater length than that the first container, which it is configured to receive within its open top end. In the illustrated embodiment, the perimeter wall 15 of the second container 13 is about double that of the first container. This creates a volume of space within the second container 13 when removably coupled with the first container. This volume of space is bounded between the base 14 and perimeter wall 15 of the second container 13 and the base 13 of the first container. In the shown embodiment, the second container 13 includes a second gasket 20 disposed along the top surface of the rim. This gasket 20 is adapted to rest flush against the bottom portion of the flange disposed on the first container. When removably coupled, the exterior surface of the first container's perimeter wall lays flush against the interior surface of the second container's 13 perimeter wall 15. In the illustrated embodiment, the gasket 20 of the second container 13 also lays flush against the gasket of the first container to create a seal via friction fit when removably coupled thereto.

Figure 5:
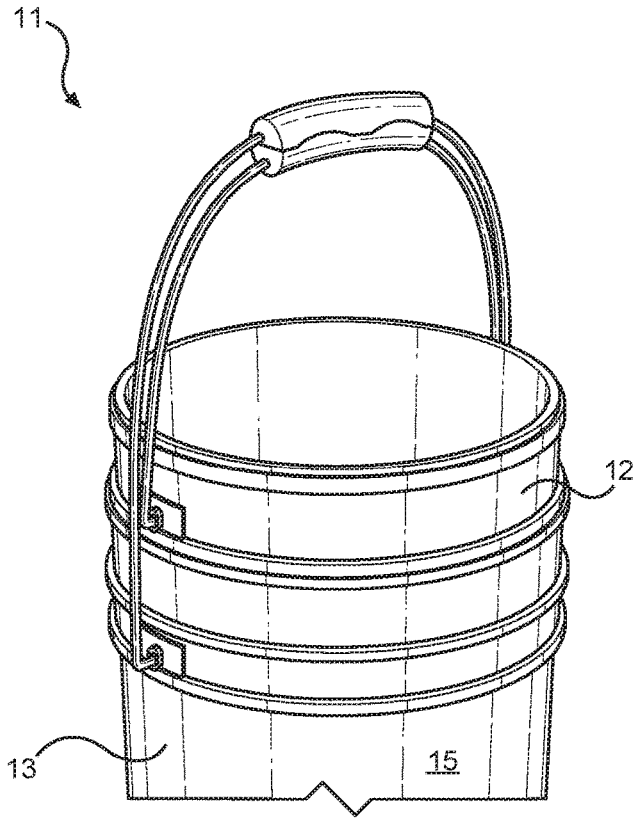
FIG. 5 shows a perspective view of an embodiment of the stackable bucket system with the handles secured to one another.
Figure 6:
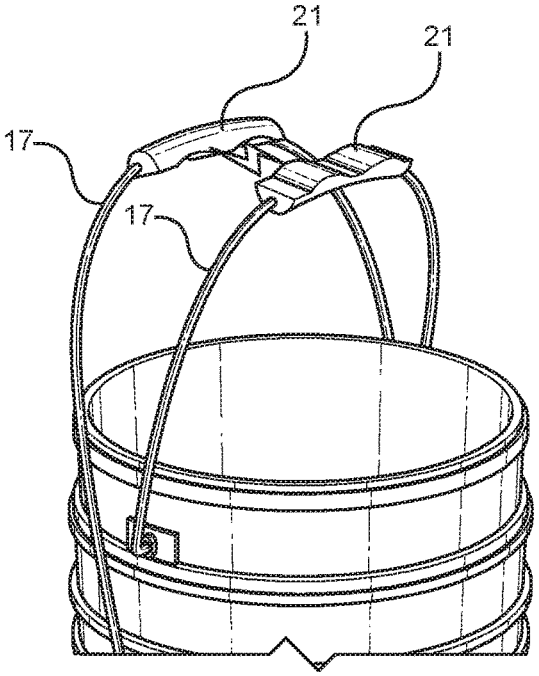
FIG. 6 shows a perspective view of an embodiment of the stackable bucket system with the handles separated from one another.
Figure 7:
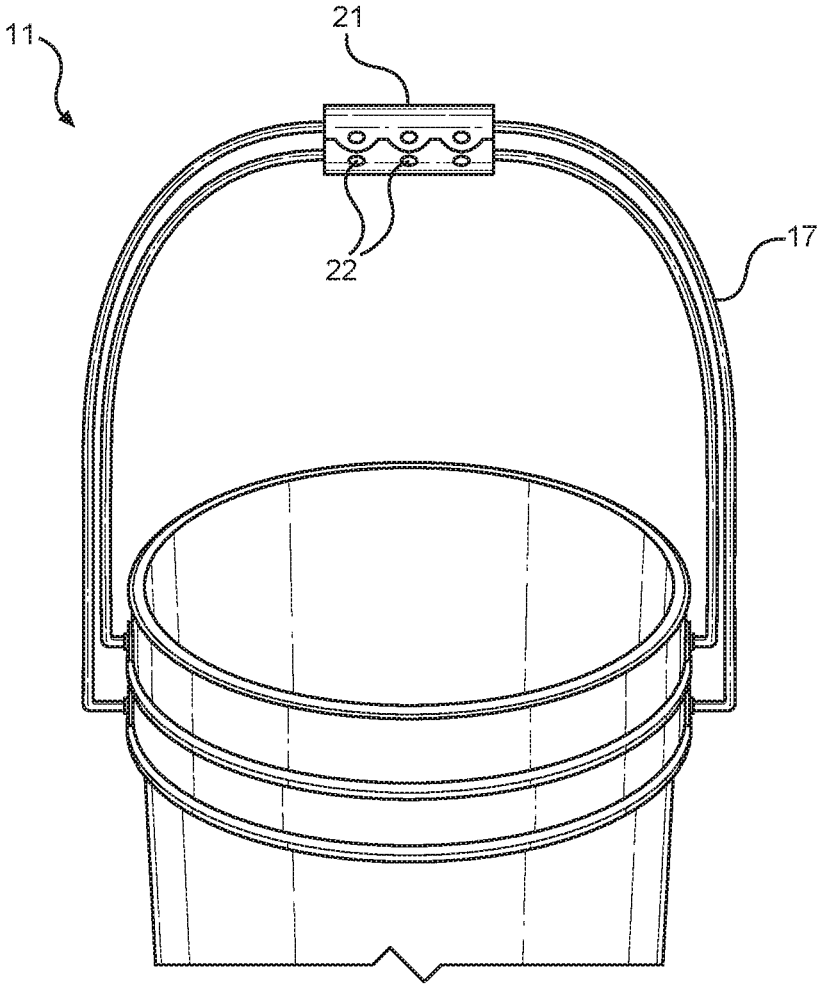
FIG. 7 shows an alternate perspective view of an embodiment of the stackable bucket system with the handles secured to one another.

Referring now to FIGS. 5 and 6, there is shown a perspective view of an embodiment of the stackable bucket system with the handles secured to one another, and a perspective view of an embodiment of the stackable bucket system with the handles separated from one another, respectively. The handles 17 pivotally disposing to opposing sides of the perimeter walls 15 of each container are configured to removably secure to one another such that a user may grasp a single handle 17 piece when transporting the stackable bucket system 11. Each handle 17 has a central grip piece 21 adapted to receive the hand of a user. The U-shaped handle 17 of the second container 13 is wider and longer than that of the first container 12 to allow for the handle 17 of the first 12 to fit underneath the second 13. In some embodiments, the handles further include magnets 22 disposed within the gripping pieces 21 that allow the handles 17 to removably attach each other via magnetic engagement, as shown in FIG. 7. However, other embodiments may not include magnets. In one embodiment of the stackable bucket system 11, the handles 17 are removably securable to one another using fasteners on the gipping pieces 21. In another embodiment of the stackable bucket system 11, each gripping piece 21 includes a patterned shape configured to fit within a complimentary pattern on the other gripping piece 21, securing the handles via a friction fit such that no additional fastener is required to secure the handles together.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stackable bucket system, comprising:

a first container and a second container, wherein each container includes a base and a perimeter wall terminating in a rim at an open top end, each container defining an interior volume, wherein the first container is configured to fit within the second container and removably secure thereto;

a handle pivotally affixed to opposing sides of the first and second containers, each handle configured to removably secure to each other when the first container is installed within the second container; and a flange protruding outwardly from the perimeter wall of each of the first container and the second container at a point lower than the handle connections which runs parallel with the rim.

2. The stackable bucket system of claim 1, further comprising a first gasket disposed on a bottom surface of the flange on the first container, and a corresponding second gasket disposed on a top surface of the rim of the second container.

3. The stackable bucket system of claim 2, wherein the first gasket comprises an O-ring, and wherein the second gasket comprises an O-ring.

4. The stackable bucket system of claim 2, further comprising a third gasket disposed on an outer surface of the perimeter wall along the base.

5. The stackable bucket system of claim 1, wherein the perimeter wall of the second container is longer than that of the first container such that a volume of space is defined between the bases of the first container and second container.

6. The stackable bucket system of claim 1, wherein the first container and the second container comprise circular cross-sectional areas.

7. The stackable bucket system of claim 1, wherein the diameter of the bases of the first and second containers is smaller than a diameter of the rims of the open tops.

8. The stackable bucket system of claim 7, wherein the base of the first container fits within the open top of the second container such that the flange of the first container contacts the rim of the second container, wherein the perimeter walls of the first container and second container rest flush against each other.

9. The stackable bucket system of claim 1, wherein the handles include a U-shape, wherein each end of the handle is pivotally affixed to opposing sides of the container.

10. The stackable bucket system of claim 9, wherein the handle of the second container is wider than that of the first container such that it may fit over top of the handle of the first container.

11. The stackable bucket system of claim 9, wherein each handle includes a central gripping piece adapted to receive the hand of a user.

12. The stackable bucket system of claim 9, further comprising a magnet configured to removably affix the handle of the first container to the handle of the second container via a magnetic connection.

13. The stackable bucket system of claim 1, further comprising a fill line within the interior surface of the perimeter wall of the second container.

* * * * *